United States Patent [19]

Galligan et al.

[11] Patent Number: 4,914,817

[45] Date of Patent: Apr. 10, 1990

[54] RAZOR HEAD WITH RIBLETS

[75] Inventors: John Galligan, Weston; John Thompson, Medfield, both of Mass.

[73] Assignee: The Gillette Company, Boston, Mass.

[21] Appl. No.: 214,464

[22] Filed: Jul. 1, 1988

[51] Int. Cl.[4] ..... B26B 21/16

[52] U.S. Cl. ..... 30/77; 30/84; 30/346.58

[58] Field of Search ..... 30/65, 74.1, 77, 78, 30/84, 346.58

[56] References Cited

U.S. PATENT DOCUMENTS

| | | | |
|---|---|---|---|
| 753,036 | 2/1904 | Bigin | 30/81 |
| 1,035,548 | 8/1912 | Dickenson . | |
| 1,117,953 | 11/1914 | Crandall | 30/51 |
| 2,105,855 | 1/1938 | Caise | 30/77 X |
| 2,262,248 | 11/1941 | O'Connor | 30/78 |
| 2,424,260 | 7/1947 | Testi | 30/65 |
| 2,546,406 | 3/1951 | Rauglas | 30/351 |
| 2,662,281 | 12/1953 | Cerino | 30/58 |
| 3,059,764 | 10/1962 | Tomita et al. | 206/59 |
| 3,263,330 | 8/1966 | Ferrara | 30/346 |
| 3,505,734 | 4/1970 | Iten | 30/346.58 |
| 3,555,682 | 1/1971 | Laszlo | 30/346.56 |
| 3,648,365 | 3/1972 | Iten et al. | 30/40 |
| 3,675,325 | 7/1972 | Michelson | 30/78 X |
| 3,750,285 | 8/1973 | Michelson | 30/346.58 |
| 4,094,066 | 6/1978 | Daniel, Jr. | 30/346.58 |
| 4,170,821 | 10/1979 | Booth | 30/41 |
| 4,443,939 | 4/1984 | Motta et al. | 30/49 |
| 4,508,606 | 4/1985 | Andrade et al. | 204/169 |
| 4,535,537 | 8/1985 | Ferraro et al. | 30/32 |

FOREIGN PATENT DOCUMENTS

| | | |
|---|---|---|
| 8804315 | 3/1989 | Brazil . |
| 0273992 | 7/1988 | European Pat. Off. . |

*Primary Examiner*—Douglas D. Watts
*Assistant Examiner*—Rinaldi Rada
*Attorney, Agent, or Firm*—Owen J. Meegan; Aubrey C. Brine; Scott R. Foster

[57] ABSTRACT

A safety razor head comprising a guard surface and a cap surface is provided with a plurality of parallel riblets disposed on the head for contact with the surface being shaved, during use of the razor. The riblets may be disposed on the cap surface or on a substantially thin film material extending from the guard surface to the cap surface and are effective to improve shaving comfort.

7 Claims, 2 Drawing Sheets

RAZOR HEAD WITH RIBLETS

BACKGROUND OF THE INVENTION

The present invention relates to safety razor construction, and more particularly, to a safety razor head which is designed to improve shaving performance of a razor having the head embodied therein.

In the field of safety razor design, there have been many attempts in the past to produce a razor having a shaving head which upon contacting the skin, during the shaving process provides the user with a more comfortable shave. The means for improving shaving performance of a razor head have taken many forms which have met with varying degrees of success.

One such shaving device is described in U.S. Pat. No. 4,170,821 issued to Anthony R. Booth which describes a solid water soluble shaving aid incorporated in a disposable razor blade cartridge, which gradually dissolves during the act of wet shaving. In this patent, it is suggested that various shaving aids in the form of lubricants, whisker softeners, medicinal agents, etc. be embedded in the solid material to be dispersed during the shaving process.

In addition, various attempts have been made to make the operation of shaving smoother and more free from irritation by a modification of the razor blade itself. In many constructions which have been proposed, the modification to the razor blade is also effective in producing a razor combination which includes a guard bar having an increased blade edge exposure over the conventional guard bar, the difference in exposure being made possible by employing a blade with the modification.

A structure of the type described above is disclosed in U.S. Pat. 3,555,682 issued to T.S. Lazlo. In that patent, a razor blade is provided with a self-contained permanently attached guard which comprises a thin, flexible sheet with a row of aligned holes and intervening lands, the holes and lands being looped over the blade cutting edge and the sheet being secured to the opposed blade surface.

The above are exemplary of attempts to improve the comfort nd safety of a safety razor which have taken many forms and include the modification of both the razor head itself as well as the blades contained therein.

In view of the above, it is an object of the present invention to improve the shaving performance of a safety razor by modification of a surface of the razor head which contacts the skin during the shaving process.

A further object of the invention is to reduce razor drag in a safety razor of the type herein disclosed.

Another object of the invention is to reduce friction between the razor head and the skin surface of the user during both wet and dry shaving.

Still a further object of the invention is to improve the comfort and safety of shaving by making the performance of a razor less dependent on maintaining the correct shaving angle.

Yet another object of the invention is to modify the shaving of a safety razor to provide for the use of high exposure blades for improved closeness of shave, without reducing shaving comfort.

SUMMARY OF THE INVENTION

The aforementioned objects and other objectives which will become apparent as the description proceeds are accomplished by providing a safety razor having a razor head comprising a guard surface and a cap surface disposed in spaced relation with blade means disposed in the space between the guard and cap surfaces and having an outwardly extending cutting edge. A plurality of parallel riblets are disposed on the shaving head for contacting a surface being shaved when the surface is contacted by the blade cutting edge.

The riblets may be disposed on the cap surface and may either be formed in the material from which the razor head is fabricated or may be formed on a strip of relatively thin film material which is adhered to the razor head to form at least a portion of the cap surface.

As an alternative to the above, a razor head comprising a guard surface and a cap surface disposed in spaced relation is provided with blade means disposed in the space between the guard and cap surfaces and having an outwardly extending cutting edge. A plurality of strips of substantially thin material extend from the guard surface to the cap surface across the space between the two surfaces, and riblets are formed on the outwardly facing surface of the plurality of strips.

The riblets preferably comprise a plurality of grooves having dimensions in the area of 0.004 inches in depth and 0.006 inches apart and when the riblets are provided on the surface of a thin film, the material is preferably a polymeric film.

BRIEF DESCRIPTION OF THE DRAWING

The foregoing and other features of the invention will be more particularly described in connection with the preferred embodiments, and with reference to the accompanying drawing, wherein.

Description of the Preferred Embodiment

Figure 1:
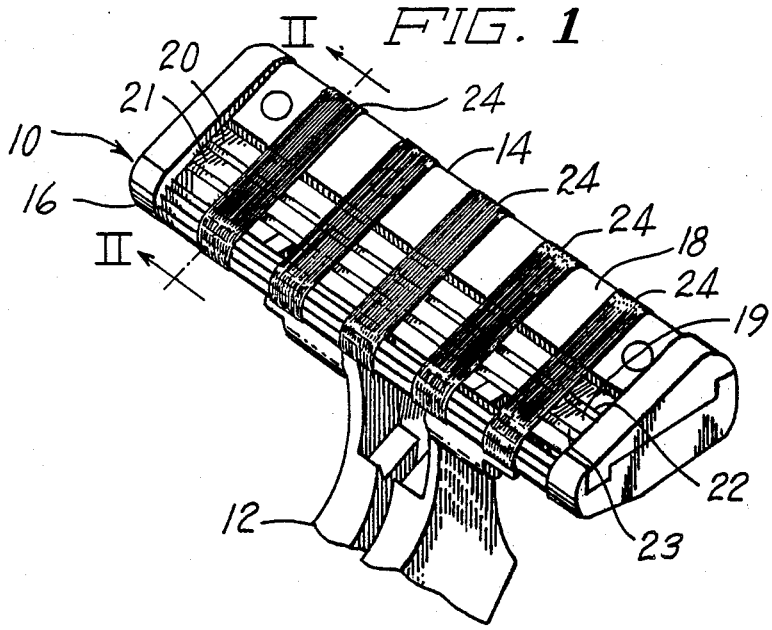
FIG. 1 is an elevational perspective view of a razor head constructed in accordance with the teachings of the present invention.
Figure 2:
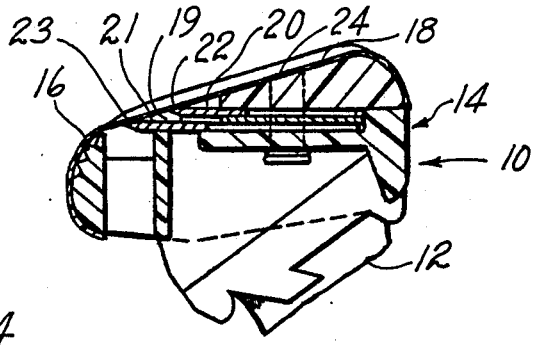
FIG. 2 is an elevational sectional view taken along the lines II—II of FIG. 1 showing details of the razor head structure of FIG. 1.

Referring now to FIGS. 1 and 2, there is shown a safety razor structure 10 comprising a handle 12 and a shaving head 14. The shaving head 14 may be permanently, or detachably mounted on the handle 12 and comprises a guard surface 16 and a cap surface 18 disposed in spaced relation to form an opening 19 between the two surfaces. Blade means in the form of a pair of razor blades 20 and 21 having cutting edges 22, 23 respectively, outwardly extend from the razor head 14 and are disposed in the opening 19, as best shown in FIG. 2.

The construction of the razor structure 10, as so far described, is similar in the broadly described elements and their relationship to one another as those safety razor constructions which are found in the marketplace, and which have been disclosed in the prior art.

Referring still to FIGS. 1 and 2, it will noted that a plurality of strips 24 of substantially thin material are affixed to the shaving head 14 and extend from the guard surface 16 to the cap surface 18. As is best shown in FIG. 2, the strips 24are in contact with the blade edges22 and 23 and contain a plurality of riblets 25 which are better shown in FIG. 5.

Figure 5:
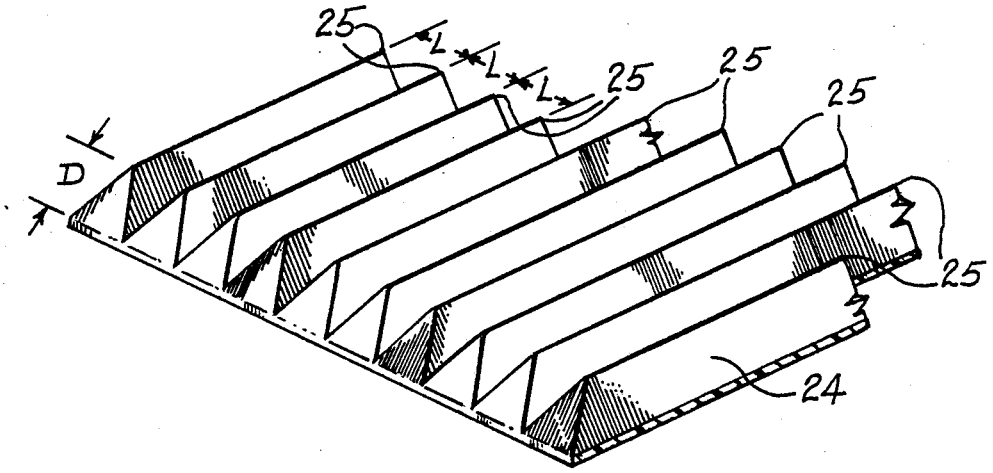
FIG. 5 is an elevational perspective view showing a portion of the surface of a razor head, as shown in FIGS. 1 through 4, taken on a greatly enlarged scale for clarity and showing features of the surface structure constructed in accordance with the present invention.

The strip 24 which has been employed in the present invention comprises a portion of a commercially produced tape sold under the trademark Scotchcal Drag Reduction Tape, which is a product of the Decorative Products Division of 3M Company, St. Paul, Minn. As best shown in FIG. 5, the riblets 25 are formed of a plurality of grooves which are V shaped and have a depth dimension D which equals in the area of 0.004 inches and a separation L of approximately 0.006 inches between each groove.

The riblets 25 are formed in a plastic film of polymeric material having a backing which is adhered to the razor head with a water resistant contact adhesive. The plurality of riblets 25 serve to reduce the friction between the skin of the user and the blades during shaving while the extension of the strip 24 between the guard surface 16 and cap surface 18 provides a secondary guard surface which reduces nicking, particularly on highly contoured surfaces of the face or legs of the user. Additionally, in the configuration shown in FIGS. 1 and 2, the location of the strip in contact with the blade edges 22 and 23 allows a blade exposure higher than that which is normally employed in a razor of this type due to the secondary guard action of the strips 24.

In FIGS. 1 and 2, a total of 5 strips 24 are shown on the shaving head 14. However, it should be understood that the strips may be of greater number, and of different spacing, so as to require less overlap of shaving strokes in order to completely shave a particular surface.

Figure 3:
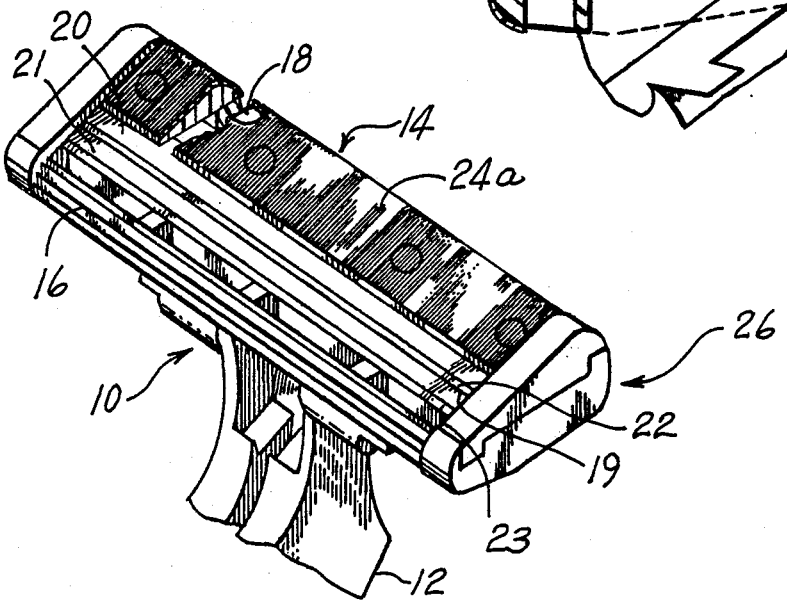
FIG. 3 is an elevational perspective view, similar to FIG. 1 showing embodiment of razor head embodying the present invention.

Referring now to FIG. 3, there is shown an alternate embodiment of the present invention wherein like elements have been given like reference numerals as those found in the structure shown in FIGS. 1 and 2. As will be observed, the cap surface 18 of a razor structure 26 has provided thereon a strip **24*a* of thin ribbed film similar to the strip 24 as described above. The strip 24*a* forms at least a portion of the cap surface 18 and is effective to improve the performance of the razor 26 by reduction of the skin friction as does the strips 24. However, the location of the strip 24*a* is not intended to provide an additional guard for the razor as do the strips 24 of the razor structure 10**.

Figure 4:
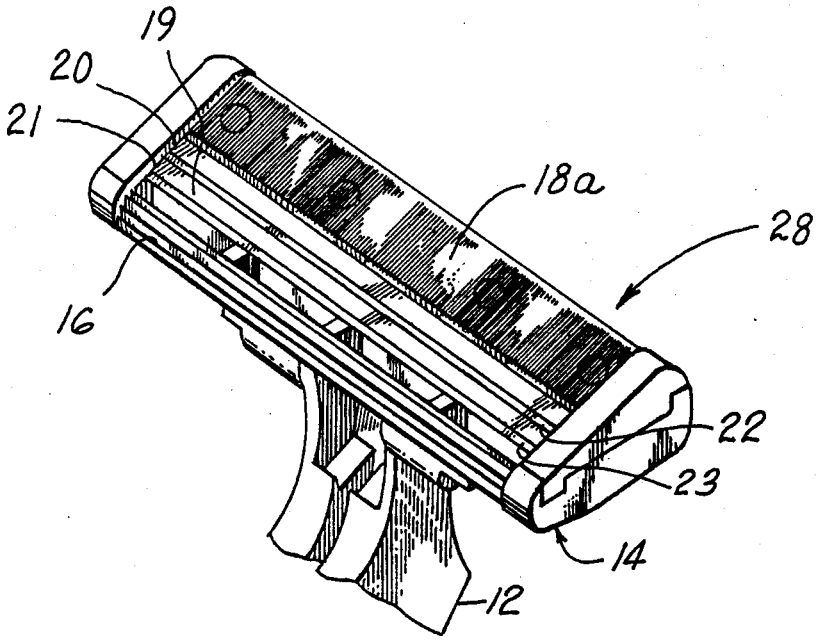
FIG. 4 is an elevational perspective view, similar to FIGS. 1 and 3 showing another alternate embodiment of a razor head the present invention.

Referring now to FIG. 4, where like elements to those of FIGS. 1 or 2 have also been assigned like reference numerals, there is shown a safety razor 28 having a plurality of riblets 25 disposed on the cap surface **18*a* to form a razor structure similar to that shown in FIG. 3. However, in the embodiment shown in FIG. 4, the riblets 25 have been formed in the material from which the razor head 14 is fabricated, rather than being applied to the cap surface 18 in tape form. The riblets 25 may be formed on the cap surface 18*a* during manufacture of the razor structure by producing a plurality of grooves in the structure as depicted in FIG. 5 having the dimensions substantially as set forth in the description of the strip material employed in the razor structure 26 and the razor structure 10**.

In combination with the riblets 25 formed on the cap surface **18*a*, riblets may also be formed on the other surfaces contacting the skin of the user such as the guard surface 16** without departing from the spirit of the present invention.

From the foregoing description, it will be appreciated that the present invention is one which improves the performance of a razor by employment of riblets 25 on surfaces which contact the skin during the shaving operation. The riblets 25 may be applied to the razor structure as a pre-formed polymeric tape, as in the instance of the strips 24 or **24*a*, or may be directly molded into the surface of a plastic component, as in the example of the cap surface 18*a***. By the disclosed construction, a safety razor is disclosed which is susceptible to construction by manufacturing practices similar to those employed in razor constructions of the prior art, while exhibiting the improved performance provided by the modification disclosed herein. Further, as only the razor head is modified in accordance with the handle arrangements, the particular blades employed etc. may be retained in their standard form and employed with the novel razor head. A razor structure is therefore provided which is simply constructed using most standard element but which has improved shaving comfort due to the reduction of friction exposure blades for improved closeness of shave without reducing comfort.

We claim:

1. A razor head comprising a guard surface and a cap surface disposed in spaced relation, blade means disposed in the space between said guard and cap surfaces, said blade means having an outwardly extending cutting edge, and a plurality of parallel riblets disposed on said shaving head for contacting a surface when said surface is contacted by said blade cutting edge, said riblets being formed on the outwardly facing surface of a plurality of strips of substantially thin material extending from said guard surface to said cap surface across the space between said surfaces.

2. A razor head as set forth in claim 1 wherein said plurality of strips are formed of a polymeric material.

3. A razor head as set forth in claim 1 wherein said riblets comprise a plurality of grooves having dimensions in the area of 0.004 inches in depth and 0.006 inches apart.

4. A razor head comprising:

a guard surface and a cap surface disposed in spaced relation, blade means disposed in the space between said guard and cap surfaces, said blade means having an outwardly extending cutting edge, and a plurality of parallel riblets disposed on said shaving head for contacting a surface when said surface is contacted by said cutting edge, said riblets comprising a plurality of grooves in the area of 0.006 inches apart and 0.004 inches in depth.

5. A razor head comprising:

a guard surface and a cap surface disposed in spaced relation, blade means disposed in the space between said guard and cap surfaces, said blade means having an outwardly extending cutting edge and a plurality of parallel riblets disposed on said shaving head for contacting a surface when said surface is contacted by said blade cutting edge, said riblets being formed on a strip of relatively thin film material adhered to said razor head to form at least a portion of said cap surface.

6. A razor head as set forth in claim 5 wherein said strip is formed of a polymeric material.

7. A razor head as set forth in claim 6 wherein said riblets comprise a plurality of grooves having dimensions in the area of 0.004 inches in depth and 0.006 inches apart.

* * * * *